United States Patent [19]

Evamy

[11] Patent Number: 4,953,705

[45] Date of Patent: Sep. 4, 1990

[54] PACKAGE HAVING DETENT-ENGAGED CUSHIONING LINING

[75] Inventor: David L. Evamy, Goring-by-Sea, England

[73] Assignee: Psychopax Limited, Worthing, England

[21] Appl. No.: 298,928

[22] Filed: Jan. 23, 1989

[30] Foreign Application Priority Data

Jan. 22, 1988 [GB] United Kingdom ..... 881393

[51] Int. Cl.[5] ..... B65D 81/10

[52] U.S. Cl. ..... 206/594; 206/523; 220/448

[58] Field of Search ..... 206/523, 524, 586, 591, 206/594; 220/445, 448, 902

[56] References Cited

U.S. PATENT DOCUMENTS

| | | | |
|---|---|---|---|
| 1,601,547 | 9/1926 | Wofford | 206/591 |
| 2,979,246 | 4/1961 | Lieberlund | 206/523 |
| 3,003,656 | 10/1961 | Hardigg | 220/448 X |
| 3,344,973 | 10/1967 | Studer | 206/523 |
| 3,416,648 | 12/1968 | Levi | 206/523 X |
| 3,516,596 | 6/1970 | Madden et al. | 206/523 |
| 3,750,871 | 8/1973 | Cook | 206/523 |
| 3,912,107 | 10/1975 | Baumann | 220/902 X |
| 4,287,265 | 9/1981 | McKnight | 220/448 X |
| 4,339,039 | 7/1982 | Mykleby | 206/523 |

FOREIGN PATENT DOCUMENTS

| | | | |
|---|---|---|---|
| 1191499 | 10/1959 | France | 206/523 |

*Primary Examiner*—Bryon P. Gehman

*Attorney, Agent, or Firm*—Lon H. Romanski

[57] ABSTRACT

There is described a package comprising a container and a lining, the package including at least one slot to receive a tab. The slot is bounded on one side by the container and on the other side by the cushioning material, which is formed with an abutment surface facing away from the entrance to the slot, and the tab includes a detent capable of engaging the abutment surface to resist withdrawal of the tab from the slot. Preferably the container is formed from folded sheet material, the lining being either a separately formed body or a plurality of tablets of cushioning material bonded to the interior surfaces of the container. The detent may be a strip of sheet material hingedly connected to the tab, or may be formed from within the tab itself.

20 Claims, 3 Drawing Sheets

PACKAGE HAVING DETENT-ENGAGED CUSHIONING LINING

The present invention relates to packaging materials and is primarily concerned with providing a rigid box from board material with a protective lining to avoid shock damage to objects placed in the box.

In the packaging field, and particularly when boxed goods are to be sent by post, the problem of protecting the goods from shock damage has been solved by the provision of a resilient packing material to fill the spaces between the box and the contents, this material being typically a granular or particulate material placed in the box with the object in situ.

An alternative solution to this packaging problem has been the development of padded envelopes, where a cushioning material is incorporated in the flexible envelope material. Clearly, while this will protect against shock damage, the flexible envelope cannot afford the degree of protection given by a rigid box, nor can envelopes be used for anything other than small objects.

According to the present invention, there is provided a package comprising a container and a lining formed of a cushioning material and including at least one slot bounded on one side by the container and on the other side by the cushioning material, the cushioning material having formed thereon an abutment surface situated within the slot and facing away from the entrance to the slot, and the container including a tab having a detent capable of entering the slot and engaging the abutment surface to resist withdrawal of the tab from the slot. The lining may be formed from a number of separate tablets of cushioning material, each bonded to the sheet material blank so as to cover the interior surface of the sheet blank. The edge regions of each tablet may be chamfered, so that when the package is erected by folding the blank, mitred corners are formed between adjacent tablets. Alternatively, the edges of the tablets may be arranged perpendicularly to the sheet material of the blank, appropriate clearances being left to permit folding of the blank. In yet a further alternative, the package may comprise a blank of sheet material foldable to form a container, and a separate pre-formed hollow lining dimensioned so as to be a close fit within the container. The lining may have a constant wall thickness and preferably has a hinged or detachable lid, and is cut away on at least one of its exterior faces so that when positioned within the container the cutaway area or areas of the lining together with their adjacent sides of the container form at least one slot to receive a tab of the container sheet material.

Advantageously the package has top, base and side panels which are rectangular, so as to form a parallelepiped when assembled. However, packages are envisaged which have polygonal top and base panels having, for example, three, six or eight sides and appropriate numbers of side panels of rectangular or trapezoidal shape.

The preferred cushioning material for the package of the present invention are expanded polystyrene or polyethylene foam, but any other similar material may be used provided that it is sufficiently rigid to offer positive location of the tab or tabs in their respective slots and has suitable shock-absorbing properties. The preferred sheet material for the blank is a board made from a corrugated filler with one or two parallel facing sheets bonded thereto, but a solid fibre board may be used.

Embodiments of the present invention will now be described in detail with reference to the accompanying drawings, in which.

Figure 1:
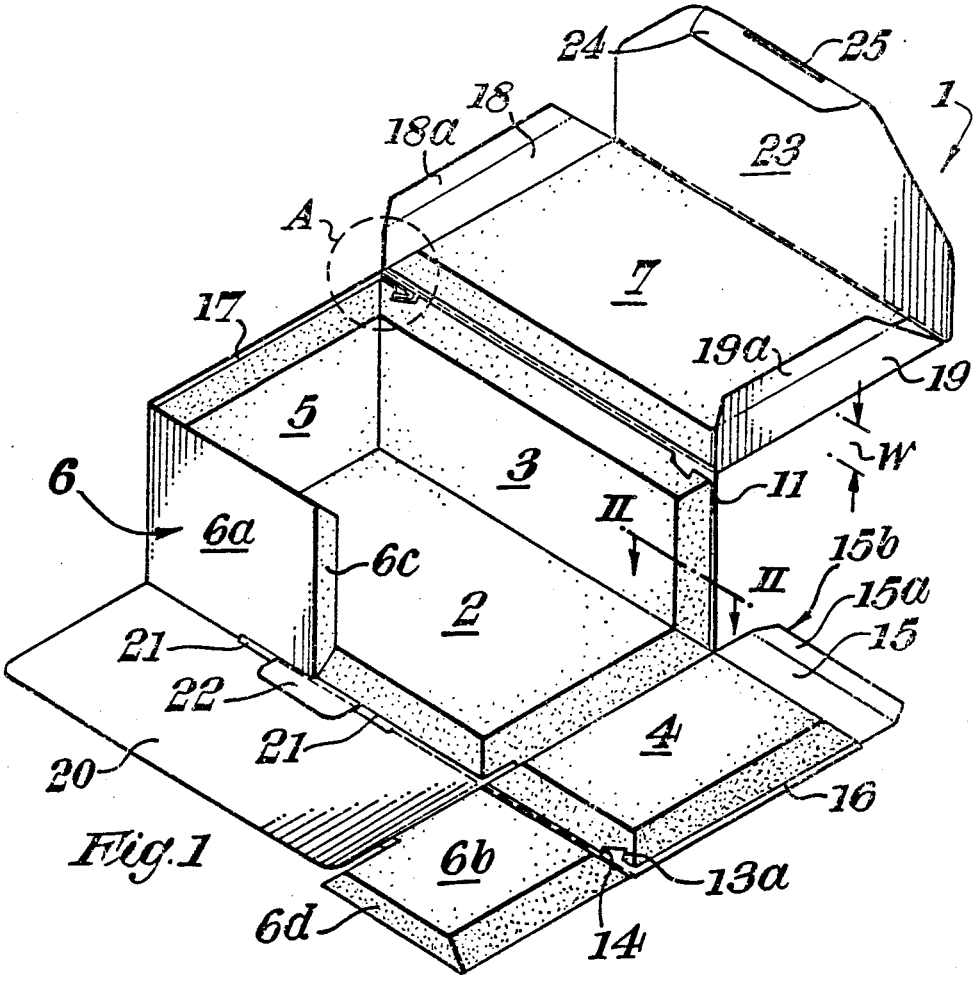
FIG. 1 shows a perspective view of a first package in a partially assembled condition.
Figure 2:
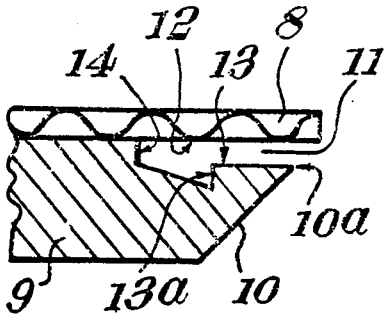
FIG. 2 shows a section along the line II—II of FIG. 1.
Figure 3:
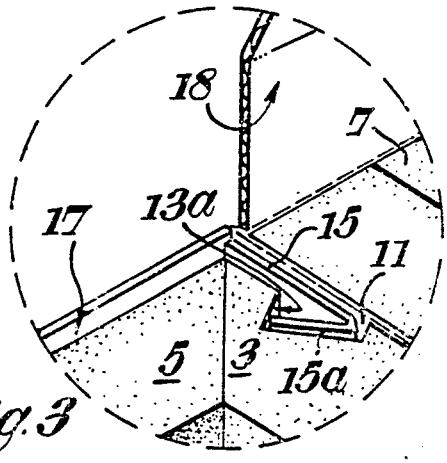
FIG. 3 is an enlarged detail view of the area within circle A of FIG. 1.

Referring now to FIGS. 1 to 3, the package 1 comprises a sheet of board material cut and creased by conventional means to form a blank comprising a base panel 2, first to fourth wall panels, 3,4,5 and 6, and a top panel 7. As best seen in FIG. 2, the panels are formed of a board sheet 8 having bonded to the face thereof a cushioning material 9 whose edges 10 are angled at 45° to the plane of the board 8. Also in the embodiment shown, the fourth wall panel 6 is formed of two panel halves 6*a* and 6*b*.

The base panel 2 is rectangular in shape and is hingedly connected along one of its longer sides to one of the longer sides of the rectangular first wall panel 3. The top panel 7, of similar rectangular shape to the base panel 2, is hinged to the other longer side of the first wall panel 3.

Along the shorter sides of first wall panel 3, the cushioning material 9 is undercut to form a slot 11 defined on one side 12 by the board sheet material 8 and on the other side 13 and at the base 14 by the cushioning material 9. The cushioning material 9 is cut so that an abutment surface 13*a* extends perpendicularly away from side surface 13 of the slot, facing towards the base 14 of the slot 11. To the shorter sides of the base panel 2 are hingedly connected respective ones of the longer sides of second and third rectangular wall panels 4 and 5. The shorter sides of second and third wall panels 4 and 5 which lie adjacent the first wall panel 3 are formed with tabs 15 of board material, the tabs 15 having a width substantially equal to the depth of the slots 11. Along the edges of the tabs 15 remote from wall panels 4 and 5 are formed detent strips 15*a*, the detent strips 15*a* having a width slightly less than the spacing between the base 14 of slot 11 and the abutment surface 13*a*. The cooperation of the tabs 15, detent strips 15*a* and slots 11 will be explained hereinafter.

The respective longer sides of the second and third wall panels 4,5 remote from the base panel 2 are likewise formed with slots 16,17 between the cushioning material 9 and the board 8. Tabs 18 and 19, extending from the shorter sides of the top panel 7, have width dimensions W corresponding to the depths of the slots 16,17. Detent strips 18*a* and 19*a*, extending respectively along the edges of tabs 18 and 19 remote from top panel 7, have a width slightly less than the spacing between the bases 14 of slots 16 and 17 and their respective abutment surfaces, 13*a*.

Hingedly attached to the shorter sides of the second and third wall panels 4,5 remote from the tabs 15 are first and second halves 6*a*,6*b* of the fourth wall panel 6. These halves have their cushioning material mitred at their junctions with the second and third wall panels, but along their edges 6*c*,6*d* opposite these junctions the cushioning material is not mitred, so that when the box is assembled the edges 6c and 6d abut to provide a continuous internal surface of cushioning material.

Extending from the edge of base panel 2 remote from the first wall panel 3 is a backing panel 20, formed with a slot 21 adjacent the central region of the hinge line joining the backing panel 20 and the base panel 2. Across the centre of the slot 21 extends a locking tongue 22, integral with the base panel. As is clear from the Figure backing panel 20 has no cushioning material bonded thereto.

Extending from the top panel 7, along its edge remote from first wall panel 3, is a closure flap 23, again of board material without cushioning material bonded thereto. From the edge of the closure flap 23 remote from the top panel 7 extends a closure tab 24, a locking slot 25 being formed adjacent the centre of the hinge line joining closure tab 24 to closure flap 23.

Since the preferred cushioning material is polystyrene foam, it is desirable to avoid the sharp edge 10a formed at the open end of the slot 11 since this will be easily deformed and could block the entrance to the slot. When the slot is formed, therefore, a shaped cutter may be used to provide a land surface adjacent the open end of the slot.

To assemble the container shown in FIG. 1, the blank is placed on a flat surface with the cushioning material uppermost, and first wall panel 3 is then brought to an upstanding position. Detent strip 15a of the tab 15 attached to second wall panel 4 is then folded to overlie its tab 15, and the tab 15 is then folded to lie in a vertical plane, the folded edge between tab 15 and detent strip 15a adjacent the open end of groove 11. Second wall panel 4 is then folded up to a vertical position, and during its raising, tab 15 and detent strip 15a enter slot 11 formed at the end of the first wall panel. When the tab 15 has entered the slot 11 sufficiently for the free edge 15b of the detent strip to pass the abutment surface 13a, the detent strip 15a springs away from the tab 15. Subsequent removal of the tab from the slot is resisted by engagement of the abutment surface 13a by the free edge 15b.

Similarly, third wall panel 5 is then raised to the vertical position, with its tab 15 and detent strip 15a entering slot 11 in the adjacent end of first wall panel 3. The engagement between tab 15, detent strip 15a and slot 11 is shown in detail in FIG. 3.

Next, the respective halves 6a,6b of fourth wall panel 6 are swung to align them with the hinge joining base panel 2 and backing panel 20, edges 6c and 6d of the panel halves 6a,6b abutting one another. Backing panel 20 is then raised to a vertical position in contact with the halves 6a,6b of the fourth wall panel 6. The box is now ready to receive its contents.

Final closure of the box is achieved by folding tabs 18,19 of top panel 7 to positions perpendicular to the top panel 7, folding the detent strips 18a, 19a to overlie the tabs 18, 19, and then bringing top panel 7 to overlie the box. Tabs 18 and 19 will respectively enter slots 17,16 in the edges of the third and second wall panels and will be retained by the detent strips 18a, 19a as previously described.

The closure flap is then swung down to overlie the backing panel 20, and with locking tongue 22 drawn back, the closure tab 24 may pass through the slot 21 to enter a slot between the cushioning material and board of base panel 2.

The final operation is to pass the locking tongue 22 upwardly through the locking slot 25 to lie between the backing panel 20 and the fourth wall panel halves 6a,6b. The locking tongue may have barbs to resist its withdrawal.

Figure 4:
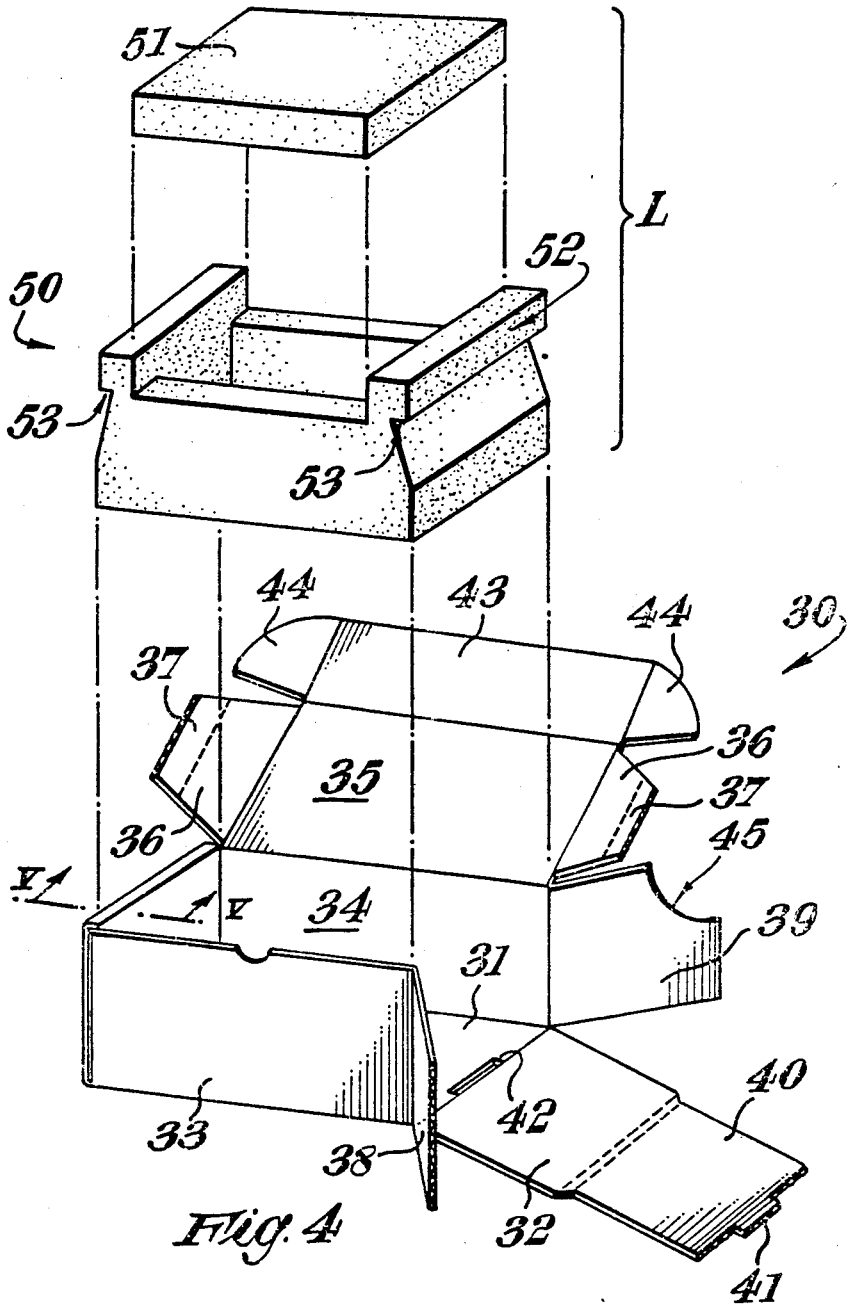
FIG. 4 is an exploded perspective view of a second package embodying teachings of the invention.
Figure 5:
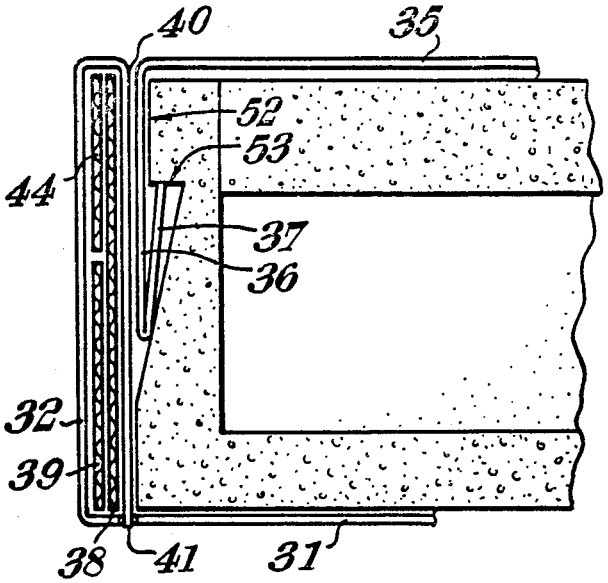
FIG. 5 is a partial section taken on the line V—V of FIG. 4 when the package is fully assembled and closed.

Referring now to FIGS. 4 and 5, there is shown a package comprising a container 30 formed from a folded sheet of board and a line L formed from cushioning material such as expanded polystyrene or polyethylene. The liner may be machined from a block, fabricated from sheets, or moulded integrally or as a number of parts.

The container 30 comprises a base 31, a pair of end walls 32, front and rear walls 33 and 34, and a top 35. The container is essentially of conventional construction, with the exception of the tabs 36 provided at the end edges of the top 35. These tabs 36 each have a detent strip 37 extending along the edge of the tab 36 remote from the top 35.

As is clear form the drawing, the container is formed by placing the blank on a flat surface, and folding front wall 33 and rear wall 34 so as to be upstanding. At each end of front wall 33 is a rectangular flap 38 substantially equal in size to the end wall 32, and these flaps 38 are then swung back towards the rear wall 34. A pair of flaps 39 on the rear wall are swung forward to lie adjacent the flaps 38, and the end walls 32 are then raised to a vertical position. A further flap 40 on each end wall 32 then folds downwardly and inwardly of the container so that the flaps 38 and 39 are securely held between the end wall 32 and the flap 40, flap 40 being retained in place by a tongue 41 engaging in a slot 42 in the base 31.

When both ends of the container are assembled, the container may be closed by lowering the top 35, and folding a closure flap 43 with end ears 44 so that the closure flap 43 lies against the outside of the front wall 33, and the ears 44 are received between the flaps 38 and the end walls 32 in spaces formed by removing a corner of flap 39 as at concave edge 45.

The lining L for the package is shown as a two-piece structure comprising a trough-like body 50 and a lid 51. With the lid in position closing the lining, the lining has external dimensions substantially corresponding to the internal dimensions of the container 30.

The lining is however cut away so that, when inserted into the container, a slot is formed between each flap 40 of the container and the adjacent end face of the lining body. The slot has an opening defined between end face 52 and flap 40, and an abutment surface constituted by surface 53 of the lining body.

To assemble the package, the container end walls are assembled as described, and the lining body is then placed within the container.

At this stage the package may be filled and closed, by placing the object to be packed within the lining body, and applying the lid.

Next, detent strips 37 are folded to overlie the tabs 36 of the container top 35, and the top is folded down over the lining lid so that tabs 36 and detent strips 37 enter the slots formed between the lining end faces 52 and the flaps 41 of the container. When the detent strips have passed the end faces 32, they resiliently spring away from the tabs 36 to engage the abutment surfaces 53 with their edges, as seen in FIG. 5. The closure flap 43 and ears 44 are then folded as previously described.

In this closed position, it will be appreciated that opening the package is only possible by either cutting the sheet material to separate the tabs 36 from the top 35 or by damaging the lining material. In either case opening is readily detectable and thus a "pilferproof" package results.

If the package is to be closed without "locking" the lid in place, for example if the package is being closed empty for subsequent reopening and filling, then after application of the lid 51 to the lining, tabs 36 and detent strips 37 are folded to lie closely adjacent the underside of top 35. The top 35 is then folded down and is held in place by the closure flap 43 and ears 44 as described.

Clearly, the lining may be made with any internal configuration, provided that its external form is such as to define with the container 30 at least one slot with an abutment surface. For example, the lining may be moulded in two identical halves which, when assembled round the object to be packed, have the required external configuration.

Figure 6:
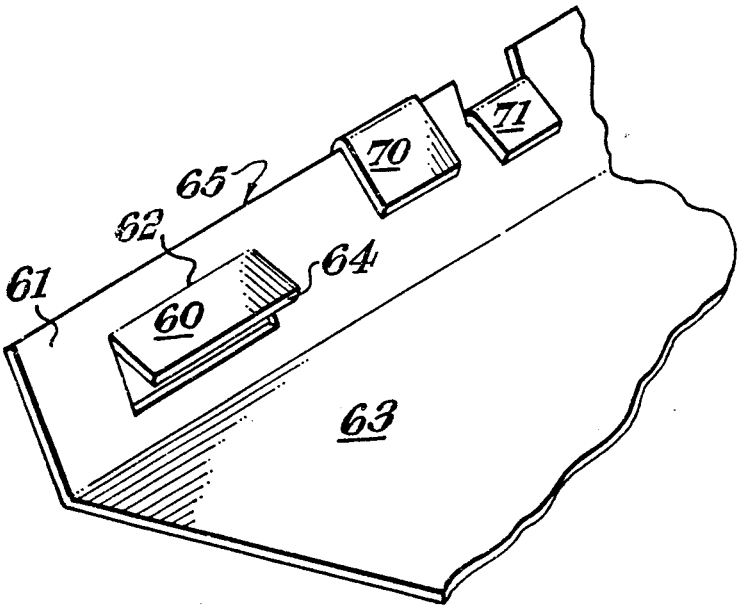
FIG. 6 shows alternative configurations for detents.

In FIG. 6 there are shown three alternative detent configurations, in the first of which a detent 60 is formed from a part of a tab 61 by making three slits in the tab 61 in a "C" formation and then folding along a line joining the ends of the "C" to raise the detent 60 out of the plane of the tab 61. Clearly, the slits may be straight or curved, but will be preferably arranged so that the fold line 62 joining the ends of the "C" is substantially parallel to the edge of the tab 61 adjoining its panel 63. The slot in the package will be substantially as described in relation to the previous embodiments, save that the width of the open end of the slot need only accommodate a single board thickness.

In use, the detent 60 is folded inward out of the plane of tab 61 to crease the fold line 62 and the tab 61 is then introduced into the slot. Again, the dimensions are such that when the tab is fully inserted, the edge 64 of the detent remote from fold line 62 just passes the abutment surface of the slot, whereupon the creased fold 62 causes the detent to return to its folded position, bringing the edge 64 into engagement with the abutment surface to prevent withdrawal of the tab 61 from the slot.

Also shown in FIG. 6 is a detent 70 formed in substantially the same way as the detents described in the embodiments of the package, save that detent 70 does not extend along the entire length of the free edge 65 of the tab 61.

Detent 71 of FIG. 6 is formed by simply slitting the tab 61 along two lines extending perpendicularly from the free edge 65, and folding along a line joining the slits to form a detent.

In accordance with another aspect of the invention, a method of producing a carton blank comprises preparing a board material by conventional cutting and creasing to provide a carton blank having a top panel, first to fourth wall panels, and a base panel, applying a cushioning material to one side of the blank in areas corresponding to the said top, base and wall panels, and at each junction between panels where the panels are not joined by folds in the board material, providing a tab extending from the one panel and undercutting the cushioning material of the other panel to form a tab-receiving slot. The cushioning material of each panel may have inclined edges to form mitred joints when the blank is assembled, or may have edges perpendicular to the board material in which case clearance will be provided on one panel of each adjoining panel pair.

The cushioning material may be applied by bonding individual pre-shaped panels of cushioning material to the respective panels of the board blank, or a single piece of cushioning material may be formed with deep grooves, extending almost through the cushioning material and having flanks inclined at 45° positioned to correspond to the hinged joints in the board blank and undercuts to correspond to the required panel edges, the single sheet of cushioning material then being bonded in position onto the board blank.

The board blank may alternatively be placed in a mould cavity and have the cushioning material moulded directly on to the board, with the slots being either formed by moving cores in the mould or by a subsequent machining operation.

The board material may be printed, waterproofed, or otherwise treated prior to the application of the cushioning material.

I claim:

1. A package comprising an outer container formed of sheet material and an inner lining formed of a cushioning material, the package including at least one elongate slot having an open entrance and two longitudinal side faces, a first longitudinal side face of the said at least one slot being defined by the sheet material of the outer container and a second longitudinal side face of the said at least one slot being defined by the cushioning material of the inner lining, the said second longitudinal side face including an abutment surface oriented substantially perpendicularly to the plane of the said first side surface of the said at least one slot and facing away from the said entrance of the said at least one slot, and the said outer container including a tab formed from the said sheet material of the outer container and having a detent, the said tab being capable of entering said at least one slot through said entrance to a position in which said detent engages said abutment surface to resist withdrawal of said tab from said at least one slot.

2. A package comprising an outer container formed of sheet material and an inner lining formed of a cushioning material, the package including at least one elongate slot having an open entrance and two longitudinal side faces, a first longitudinal side face of the said at least one slot being defined by the sheet material of the outer container and a second longitudinal side face of the said at least one slot being defined by the cushioning material of the inner lining, the said second longitudinal side face including an abutment surface oriented substantially perpendicularly to the plane of the said first side surface of the said at least one slot and facing away from the said entrance of the said at least one slot, and the said outer container including a tab formed from the said sheet material of the outer container and having a detent, the said tab being capable of entering said at least one slot through said entrance to a position in which said detent engages said abutment surface to resist withdrawal of said tab from said at least one slot, and wherein the detent is a strip of sheet material extending along one edge of the tab and hingedly joined thereto.

3. A package according to claim 2, wherein the detent extends only part way along the tab.

4. A package comprising an outer container formed of sheet material and an inner lining formed of a cushioning material, the package including at least one elongate slot having an open entrance and two longitudinal side faces, a first longitudinal side face of the said at least one slot being defined by the sheet material of the outer container and a second longitudinal side face of the said at least one slot being defined by the cushioning material of the inner lining, the said second longitudinal side face including an abutment surface oriented substantially perpendicularly to the plane of the said first side surface of the said at least one slot and facing away from the said entrance of the said at least one slot, and the said outer container including a tab formed from the said sheet material of the outer container and having a detent, the said tab being capable of entering said at least one slot through said entrance to a position in which said detent engages said abutment surface to resist withdrawal of said tab from said at least one slot, and wherein the detent is formed from the sheet material of the tab, the detent being bound by a hinge connection to the tab at a side of the detent adjacent a free edge of the tab.

5. A package comprising an outer container formed of sheet material and an inner lining formed of a cushioning material, the package including at least one elongate slot having an open entrance and two longitudinal side faces, a first longitudinal side face of the said at least one slot being defined by the sheet material of the outer container and a second longitudinal side face of the said at least one slot being defined by the cushioning material of the inner lining, the said second longitudinal side face including an abutment surface oriented substantially perpendicularly to the plane of the said first side surface of the said at least one slot and facing away from the said entrance of the said at least one slot, and the said outer container including a tab formed from the said sheet material of the outer container and having a detent, the said tab being capable of entering said at least one slot through said entrance to a position in which said detent engages said abutment surface to resist withdrawal of said tab from said at least one slot, and wherein the detent is also a strip of sheet material carried by said tab at least near an edge of said tab and hingedly joined to said tab.

6. A package according to claim 5 wherein said sheet material of said outer container comprises a blank of sheet material, wherein said blank of sheet material comprises a plurality of panels forming walls of said outer container, and wherein said inner lining comprises a plurality of tablets of said cushioning material bonded to said panels.

7. A package according to claim 5 wherein said sheet material of said outer container comprises a blank of sheet material, and wherein said inner lining comprises a hollow body having external dimensions substantially corresponding to internal dimensions of said outer container.

8. A package according to claim 7 wherein said inner lining comprises a trough-like body and a lid for said body.

9. A package comprising an outer container formed of sheet material and an inner lining formed of a cushioning material, the package including at least one elongate slot having an open entrance and two longitudinal side faces, a first longitudinal side face of the said at least one slot being defined by the sheet material of the outer container and a second longitudinal side face of the said at least one slot being defined by the cushioning material of the inner lining, the said second longitudinal side face including an abutment surface oriented substantially perpendicularly to the plane of the said first side surface of the said at least one slot and facing away from the said entrance of the said at least one slot, and the said outer container including a tab formed from the said sheet material of the outer container and having a detent, the said tab being capable of entering said at least one slot through said entrance to a position in which said detent engages said abutment surface to resist withdrawal of said tab from said at least one slot, wherein said detent is formed from the sheet material of said tab, wherein said tab comprises a freely swingable edge, and wherein said detent is operatively connected by a hinge connection to said tab at an area of said tab at least close to said freely swingable edge.

10. A package according to claim 9 wherein said sheet material of said outer container comprises a blank of sheet material, wherein said blank of sheet material comprises a plurality of panels forming walls of said outer container, and wherein said inner lining comprises a plurality of tablets of said cushioning material bonded to said panels.

11. A package according to claim 9 wherein said sheet material of said outer containing comprises a blank of sheet material, and wherein said inner lining comprises a hollow body having external dimensions substantially corresponding to internal dimensions of said outer container.

12. A package according to claim 11 wherein said inner lining comprises a trough-like body and a lid for said body.

13. A package comprising a container and a lining formed of a cushioning material, the container being formed by folding a blank cut from sheet material to provide a closed container having a base, a plurality of sidewalls upstanding from the base, and a lid extending between the upper boundaries of the sidewalls, each of the said base, sidewalls, and lid having an interior and an exterior face, and the lining having a number of external faces, each lying against the interior face of a respective one of the said base, sidewalls and lid of the container, at least one edge region of one external face being configured in such a way that in the assembled condition of the container a slot is defined between said region of said one external face and the interior face of the said one of the base, sidewalls and lid of the container, the slot having an open side situated at the periphery of the said one external face and including an abutment surface situated within the slot and facing away from the open side, the package further including a tab extending from an edge of a second one of the base, sidewalls and lid of the container, the said edge of the said second one of said base, sidewalls and lid of the container being that edge which, in the assembled condition of the package, lies adjacent the said open side of said slot, the said tab being capable of entering said slot and the tab having a detent surface facing towards said edge of said second one of the base, sidewalls and lid of the container, said detent surface being capable of engaging the said abutment surface within said slot to resist removal of said tab from said slot.

14. A package according to claim 13 wherein the tab is attached by a first hinge line to said one of said base, sidewalls and lid of the container, and a flap is attached to the tab by a second hinge line parallel to the said first hinge line, the flap having a free edge extending parallel to the second hinge line and said free edge constituting the said detent surface.

15. A package according to claim 14 wherein prior to folding the blank, said second hinge line lies between said free edge and said first hinge line.

16. A package according to claim 15 wherein the distance between said first and second hinge lines is equal to the dimension of the tab measured perpendicular to said edge.

17. A package according to claim 15 wherein the distance between said first and second hinge lines is less than the dimension of the tab measured perpendicular to said edge.

18. A package according to claim 14 wherein prior to folding the blank, the said free edge lies between said first and second fold lines, and the distance between said first and second fold lines is less than the dimension of the tab measured perpendicular to said edge.

19. A package according to claim 13 wherein the lining comprises a plurality of planar lining panels defining a closed internal cavity.

20. A package according to claim 13 wherein the lining comprises a trough-like body and a planar lid.

* * * * *